US012320208B2

(12) United States Patent
Johnson et al.

(10) Patent No.: US 12,320,208 B2
(45) Date of Patent: Jun. 3, 2025

(54) HANDS-FREE GOOSENECK AND HANDS-FREE GOOSENECK FLOW SPOOL

(71) Applicant: GRANT PRIDECO, INC., Houston, TX (US)

(72) Inventors: Austin Johnson, The Woodlands, TX (US); Justin Fraczek, Spring, TX (US); Alexander John MacGregor, Kirkcudbright (GB)

(73) Assignee: GRANT PRIDECO, INC., Houston, TX (US)

( * ) Notice: Subject to any disclaimer, the term of this patent is extended or adjusted under 35 U.S.C. 154(b) by 0 days.

(21) Appl. No.: 18/104,633

(22) Filed: Feb. 1, 2023

(65) Prior Publication Data

US 2024/0254842 A1 Aug. 1, 2024

(51) Int. Cl.

| | |
|---|---|
| ***E21B 17/01*** | (2006.01) |
| ***E21B 17/02*** | (2006.01) |
| ***E21B 17/08*** | (2006.01) |

(52) U.S. Cl.

CPC ..... *E21B 17/085* (2013.01)

(58) Field of Classification Search

None

See application file for complete search history.

(56) References Cited

U.S. PATENT DOCUMENTS

| | | | | |
|---|---|---|---|---|
| 4,668,126 | A * | 5/1987 | Burton | E21B 19/002 166/341 |
| 9,611,704 | B2 * | 4/2017 | Springett | E21B 19/006 |
| 9,719,310 | B2 * | 8/2017 | MacGregor | E21B 19/004 |
| 2012/0141212 | A1 * | 6/2012 | Long | E21B 41/0014 405/190 |

OTHER PUBLICATIONS

EPO Extended European Search Report issued in EP 24154116.8, filed on Jan. 26, 2024, mailed on Apr. 2, 2024.

* cited by examiner

*Primary Examiner* — Matthew R Buck
*Assistant Examiner* — Douglas S Wood
(74) *Attorney, Agent, or Firm* — Basil M. Angelo; ANGELO IP

(57) ABSTRACT

A hands-free gooseneck flow spool includes a mandrel, a hands-free gooseneck receiver fixedly attached to the mandrel, and a hands-free gooseneck removably attached to the hands-free gooseneck receiver. The hands-free gooseneck receiver includes a lockable gooseneck receiver including a gooseneck receiver end fluidly connected to a mandrel connection end, a rotatable locking collar at least partially disposed within the gooseneck receiver end of the lockable gooseneck receiver, and a plurality of alignment pins. The hands-free goose neck includes a substantially U-shaped gooseneck pipe member including a hose connection end that is fluidly connected to a receiver connection end, a hands-free connection system including a pad-eye track disposed on the U-shaped gooseneck pipe member and a pad-eye shackle movably attached to the pad-eye track, and a plurality of alignment pin receivers disposed near the receiver connection end.

6 Claims, 17 Drawing Sheets

200

HANDS-FREE GOOSENECK AND HANDS-FREE GOOSENECK FLOW SPOOL

BACKGROUND OF THE INVENTION

Conventional closed-loop hydraulic drilling systems, sometimes referred to in the industry as managed pressure drilling ("MPD") systems, include an annular sealing system, a drill string isolation tool, and a flow spool, or equivalents thereof, that actively manage wellbore pressure during drilling and other operations. The annular sealing system typically includes an active control device ("ACD"), a rotating control device ("RCD"), or other type of sealing element that seal the annulus surrounding the drill string or drill pipe such that the annulus is encapsulated and not atmospheric. While the type and kind of annular sealing system may vary based on an application or design, the annular sealing system is designed to maintain a pressure tight seal on the annulus while the drill string or drill pipe is rotated.

The drill string isolation tool is disposed directly below the annular sealing system and typically includes an additional sealing element that is used to encapsulate the well and maintain annular pressure while the annular sealing system, or components thereof, are being installed, serviced, removed, or otherwise disengaged. The flow spool is disposed directly below the drill string isolation tool and, as part of the pressurized fluid return system, diverts returning fluids from below the annular seal to the surface. The flow spool is in fluid communication with a choke manifold, typically disposed on a platform of the drilling rig, that is in fluid communication with a mud-gas separator, shale shaker, or other fluids processing system disposed on a platform of the drilling rig. The pressure tight seal on the annulus allows for the precise control of wellbore pressure by manipulation of the choke settings of the choke manifold and the corresponding application of surface backpressure.

MPD systems are used in both onshore and offshore applications, including, but not limited to, underbalanced drilling ("UBD"), pressurized mud cap drilling ("PMCD"), applied surface backpressure ("ASBP")-MPD, and other MPD drilling applications. However, MPD systems are increasingly becoming necessary, and in some cases, even required, in deepwater and ultra-deepwater applications. In these applications, the annular sealing system, drill string isolation tool, and flow spool are typically configured as part of an integrated MPD riser joint that is installed as part of the upper marine riser system. The integrated MPD riser joint may exceed 50 feet in length and weigh more than 100,000 pounds.

BRIEF SUMMARY OF THE INVENTION

According to one aspect of one or more embodiments of the present invention, a hands-free gooseneck includes a substantially U-shaped gooseneck pipe member including a hose connection end that is fluidly connected to a receiver connection end, a hands-free connection system including a pad-eye track disposed on the U-shaped gooseneck pipe member and a pad-eye shackle movably attached to the pad-eye track, and a plurality of alignment pin receivers disposed near the receiver connection end.

According to one aspect of one or more embodiments of the present invention, a hands-free gooseneck flow spool includes a mandrel, a hands-free gooseneck receiver fixedly attached to the mandrel, and at least one hands-free gooseneck that is removably attached to the hands-free gooseneck receiver. The hands-free gooseneck receiver includes a lockable gooseneck receiver including a gooseneck receiver end fluidly connected to a mandrel connection end, a rotatable locking collar at least partially disposed within the gooseneck receiver end, and a plurality of alignment pins. The hands-free gooseneck includes a substantially U-shaped gooseneck pipe member including a hose connection end that is fluidly connected to a receiver connection end, a hands-free connection system including a pad-eye track disposed on the U-shaped gooseneck pipe member and a pad-eye shackle movably attached to the pad-eye track, and a plurality of alignment pin receivers disposed near the receiver connection end. The rotatable locking collar locks the hands-free gooseneck to the hands-free gooseneck receiver in a locked position.

Other aspects of the present invention will be apparent from the following description and claims.

DETAILED DESCRIPTION OF THE INVENTION

Figure 1A:
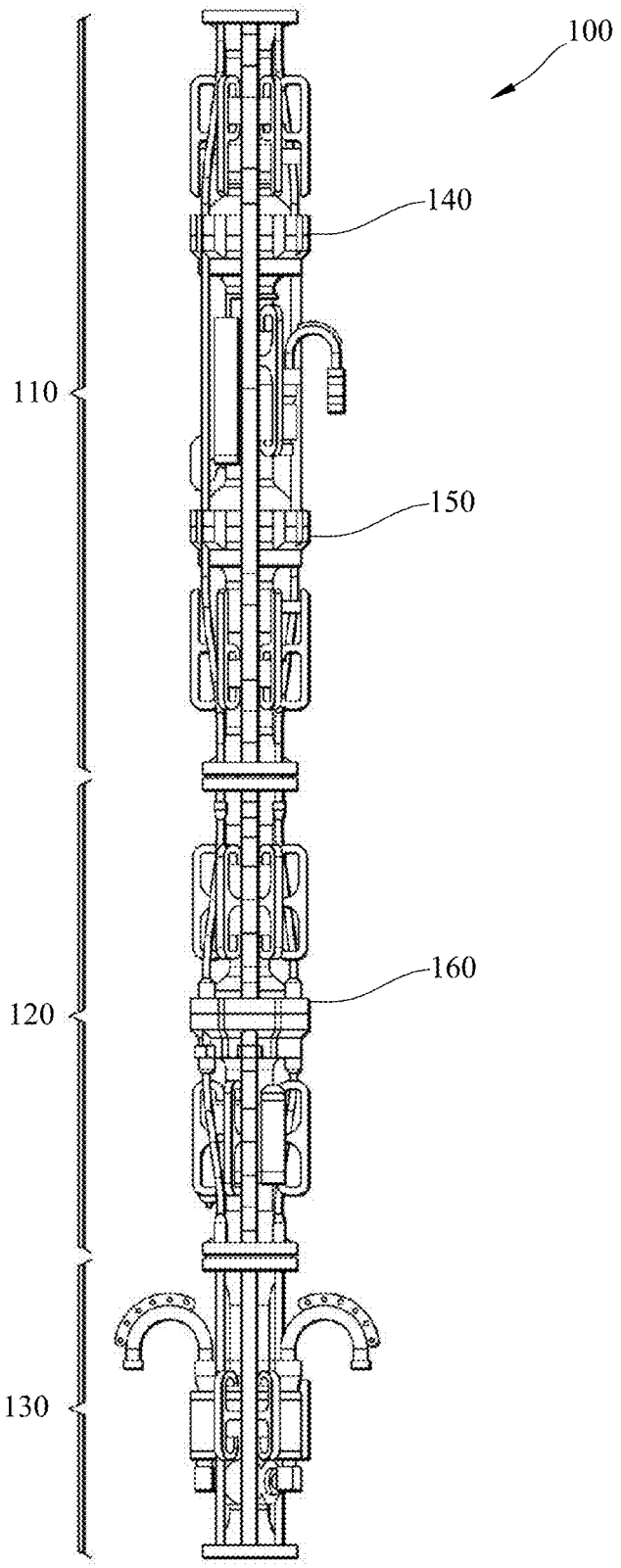
FIG. 1A PRIOR ART
FIG. 1A shows an elevation view of a conventional managed pressure drilling riser joint including a conventional flow spool.

One or more embodiments of the present invention are described in detail with reference to the accompanying figures. For consistency, like elements in the various figures are denoted by like reference numerals. In the following detailed description of the present invention, specific details are described to provide a thorough understanding of the present invention. In other instances, aspects that are well-known to those of ordinary skill in the art are not described to avoid obscuring the description of the present invention.

FIG. 1A shows an elevation view of a conventional managed pressure drilling riser joint 100 including a conventional flow spool 130. In offshore applications, a floating vessel (not shown), such as, for example, a semi-submersible, drillship, drill barge, or other floating rig or platform may be disposed over a body of water to facilitate drilling or other operations. A marine riser system (not independently illustrated) may provide fluid communication between the floating vessel (not shown) and a lower marine riser package ("LMRP")/sub-sea blow-out preventer ("SSBOP") (not shown) disposed on or near the ocean floor. The LMRP/SSBOP (not shown) are in fluid communication with the wellhead (not shown) of the wellbore (not shown). In below-tension-ring configurations (not independently illustrated) of an MPD system, the conventional integrated MPD riser joint 100 is typically disposed below the telescopic joint (not shown). Conventional integrated MPD riser joint 100 includes an annular sealing system 110 disposed below a bottom distal end of the telescopic joint (not shown), a drill string isolation tool 120, or equivalent thereof, disposed directly below annular sealing system 110, and a conventional flow spool 130, or equivalent thereof, disposed directly below drill string isolation tool 120. Annular sealing system 110 may be an ACD-type, RCD-type (not shown), or other type or kind of sealing system (not shown) that seals the annulus (not shown) surrounding the drill string or drill pipe (not shown) such that the annulus is encapsulated and not exposed to the atmosphere. In the ACD-type embodiment depicted, annular sealing system 110 includes an upper sealing element 140 (not shown, reference numeral depicting general location only) and a lower sealing element 150 (not shown, reference numeral depicting general location only) that seals the annulus surrounding the drill string or drill pipe (not shown). Upper sealing element 140 and lower sealing element 150 are typically attached to opposing ends of a mandrel, collectively referred to as a dual seal sleeve, and are engaged or disengaged at the same time. The redundant sealing mechanism extends the life of the sealing elements and increases the safety of operations.

Drill string isolation tool 120, or equivalent thereof, is disposed directly below annular sealing system 110 and provides an additional sealing element 160 (not shown, reference numeral depicting general location only) that encapsulates the well and seals the annulus surrounding the drill string or drill pipe when annular sealing system 110, or components thereof, are being installed, serviced, maintained, removed, or otherwise disengaged. For example, when sealing elements 140 and 150 require replacement while the marine riser is pressurized, such as, for example, during hole sections in between bit runs, drill string isolation tool 120 is engaged to maintain annular pressure while annular sealing system 110 is taken offline. To ensure the safety of operations, sealing element 160 seals the annulus surrounding the drill pipe (not shown) while the sealing elements 140 and 150 of annular sealing system 110 are removed and replaced. Conventional flow spool 130, or equivalents thereof, is disposed directly below drill string isolation tool 120 and, as part of the pressurized fluid return system, diverts returning fluids (not shown) from below the annular seal to the surface (not shown). Conventional flow spool 130 is in fluid communication with a choke manifold (not shown), typically disposed on a platform of the floating rig (not shown), that is in fluid communication with a mud-gas separator, shale shaker, or other fluids processing system (not shown) disposed on the surface. The pressure tight seal on the annulus provided by annular sealing system 110 allows for the precise control of wellbore pressure by manipulation of the choke settings of the choke manifold (not shown) and the corresponding application of surface backpressure. If the driller wishes to increase wellbore pressure, one or more chokes of the choke manifold (not shown) may be closed somewhat more than their last setting to further restrict fluid flow and apply additional surface backpressure. Similarly, if the driller wishes to decrease wellbore pressure, one or more chokes of the choke manifold (not shown) may be opened somewhat more than their last setting to increase fluid flow and reduce the amount of surface backpressure applied.

Figure 1B:
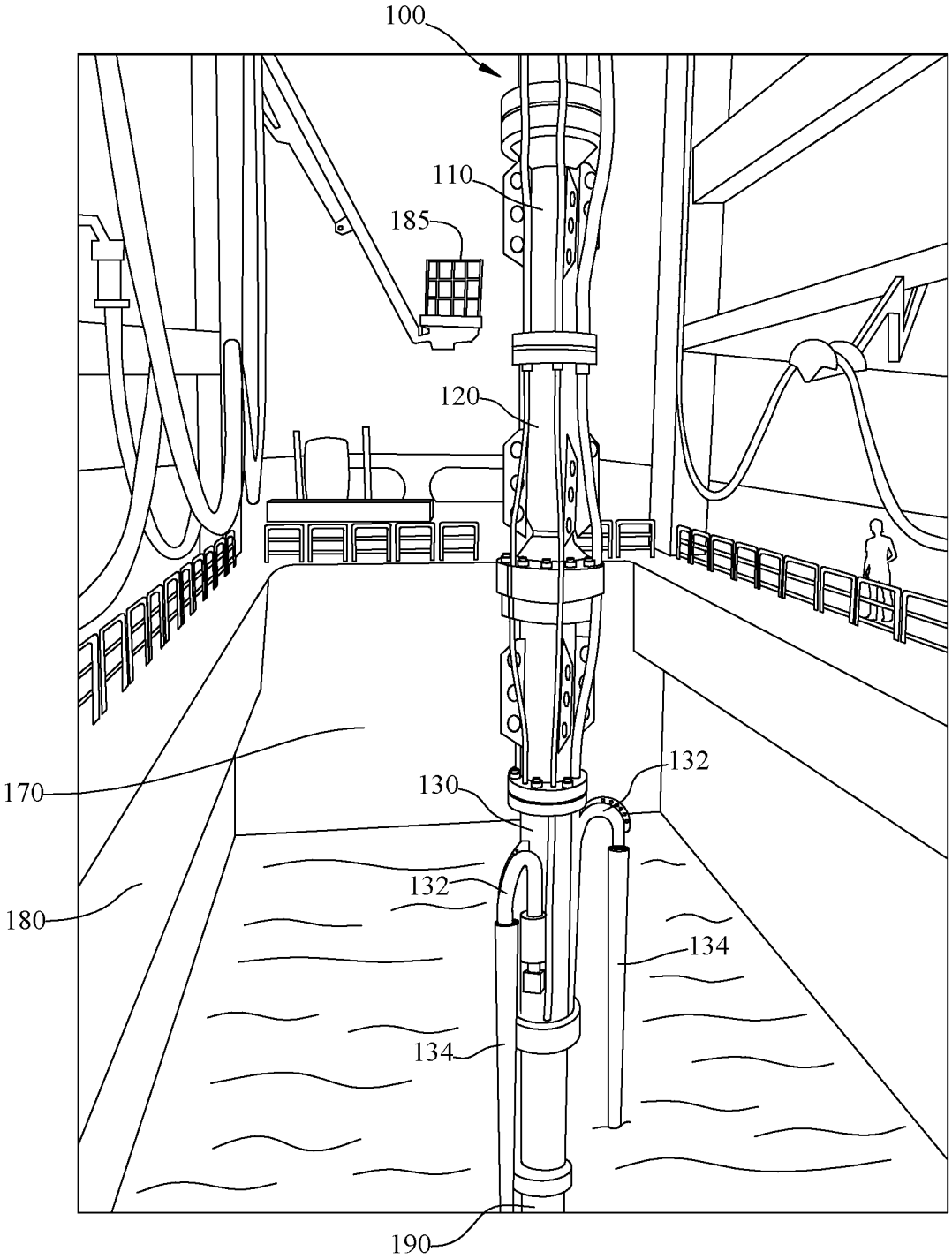
FIG. 1B PRIOR ART
FIG. 1B shows an environmental view of a conventional managed pressure drilling riser joint during construction of a marine riser system.

FIG. 1B shows an environmental view of a conventional MPD riser joint 100 during construction of a marine riser system. Portions of the marine riser including, for example, marine riser pipe segment 190 and conventional MPD riser joint 100 may be assembled in whole or in part on the deck (not shown) of a floating vessel 180 and lowered through an aperture (not shown) of the rotary table (not shown) on the drilling platform (not shown) into a moon pool area 170 of the floating vessel 180. Because the aperture (not shown) of the rotary table (not shown) has a limited diameter, conventional MPD riser joint 100 is lowered through the aperture (not shown) of the rotary table (not shown) without the goosenecks 132 or flexible hoses 132 of conventional flow spool 130 attached.

While a driller (not shown) on the drilling platform (not shown) operates the hoisting system (not shown), a rig hand (not shown) is lowered in a basket 185 into the moon pool area 170 to attach the goosenecks 132 and flexible hoses 132 to conventional flow spool 130. The rig hand (not shown), working from the basket 185, is required to manually align each gooseneck 132 to the conventional flow spool 130 one at a time, make each of the necessary connections, and apply substantial force to rotate each gooseneck 132 relative to the flow spool 130 to lock it into place, all of which is performed in a dangerous and unstable environment that is moving. While efforts are taken to stabilize the floating vessel 180, it is still subject to some degree of yawing, pitching, and rolling as well as heaving with periodic movement of the ocean. The rig hand (not shown) working from the basket 185 in the moon pool area 170 is surrounded by the metal structures of the floating vessel 180 and with open ocean below. In this environment, the rig hand (not shown) must perform the assembly operation manually from the basket 185. The substantial weight of the goosenecks 132 and flexible hoses 134, the movement of the floating vessel 180, and the environment in which the rig hand (not shown) is required to work makes the assembly operation exceptionally difficult and dangerous.

Accordingly, in one or more embodiments of the present invention, a hands-free gooseneck and hands-free gooseneck flow spool simplifies and improves the safety of flow spool assembly operations. Each hands-free gooseneck may include a hands-free connection system that facilitates lowering the hands-free gooseneck into a hands-free gooseneck receiver with a hoisting system. The hands-free gooseneck may include a plurality of alignment pin receivers and the hands-free gooseneck receiver may include a corresponding plurality of alignment pins that facilitate aligning the hands-free goosenecks while they are being lowered into their respective hands-free gooseneck receivers. Each hands-free gooseneck receiver may include a rotatable locking collar that easily rotates to lock a hands-free gooseneck into place, without requiring that the hands-free gooseneck be rotated or otherwise manipulated with substantial force to secure it into place. Advantageously, the hands-free gooseneck and hands-free gooseneck flow spool simplifies the flow spool assembly operation including lowering, aligning, and attaching each hands-free gooseneck to a corresponding hands-free gooseneck receiver and does not require substantive manual force or the rotation of the gooseneck to secure each hands-free gooseneck in their respective hands-free gooseneck receiver.

Figure 2A:
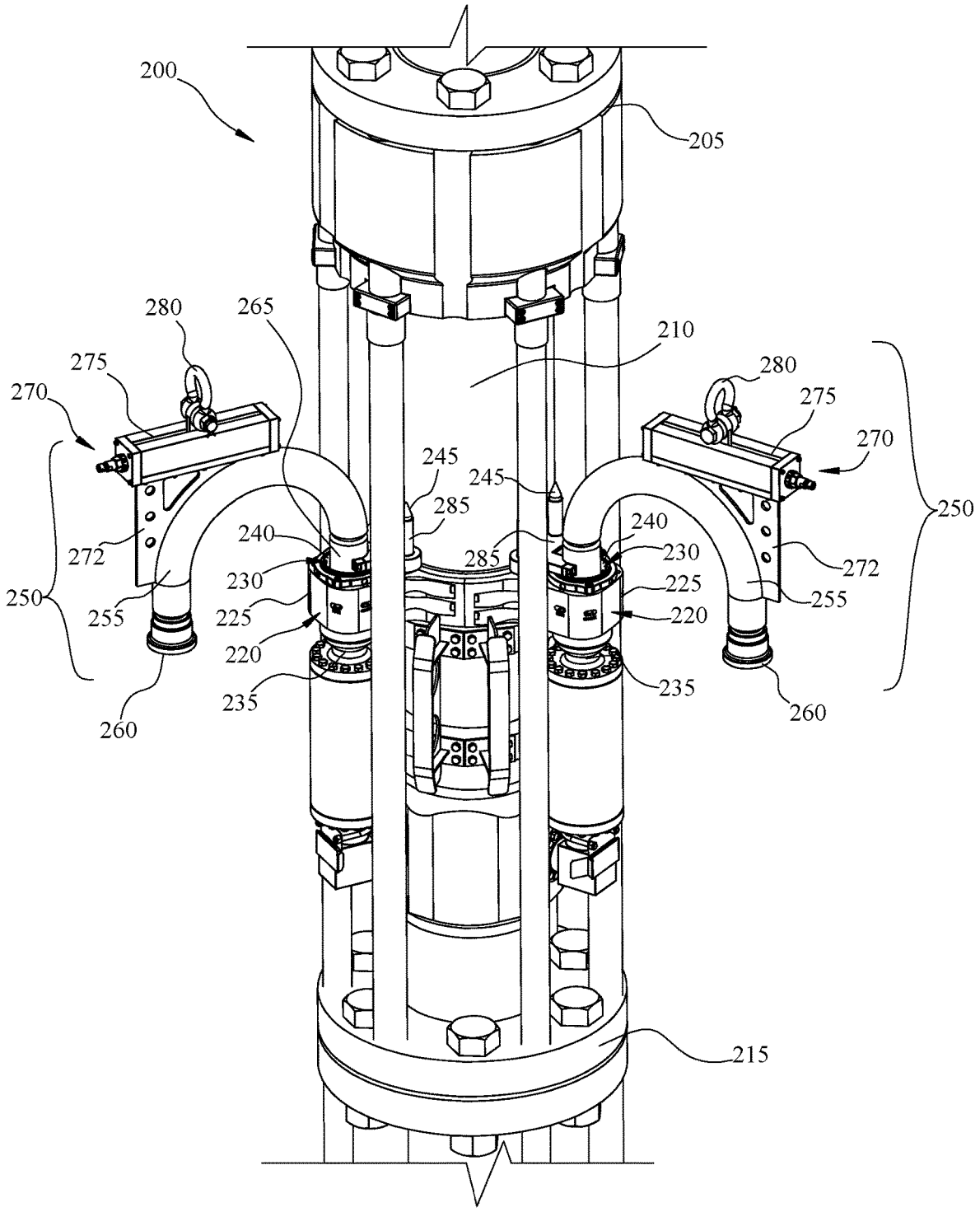
FIG. 2A shows a top-facing front perspective view of a hands-free gooseneck flow spool in accordance with one or more embodiments of the present invention.

FIG. 2A shows a top-facing front perspective view of a hands-free gooseneck flow spool 200 in accordance with one or more embodiments of the present invention. Hands-free gooseneck flow spool 200 may include an upper mandrel connection end 205, a mandrel 210, and a lower mandrel connection end 215, where the mandrel 210 comprises a central lumen (not shown) that provides fluid connectivity from end-to-end as part of the upper marine riser system (not shown). The upper mandrel connection end 205 may comprise a flange or other connector that provides mechanical connectivity with, for example, a drill string isolation tool (e.g., 120 of FIG. 1B), or another component disposed above the hands-free gooseneck flow spool 200. The lower mandrel connection end 215 may comprise a flange or other connector that provides mechanical connectivity with, for example, a marine riser pipe segment (e.g., 190 of FIG. 1B), or another component disposed below hands-free gooseneck flow spool 200.

Hands-free gooseneck flow spool 200 may include a plurality of hands-free gooseneck receivers 220 fixedly attached to the mandrel 210. Each hands-free gooseneck receiver 220 may include a lockable gooseneck receiver 225 comprising a gooseneck receiver end 230 fluidly connected to a mandrel connection end 235, a rotatable locking collar 240 at last partially disposed within each gooseneck receiver end 230, and a plurality of alignment pins 245. Mandrel connection end 235 may provide fluid connectivity with the central lumen (not shown) of mandrel 210.

Each hands-free gooseneck 250 may include a substantially U-shaped gooseneck pipe member 255 comprising a hose connection end 260 that is fluidly connected to a receiver connection end 265 comprising a fixed locking collar (e.g., 268), a hands-free connection system 270 comprising a pad-eye track 275 fixedly attached to the U-shaped gooseneck pipe member 255 by an angle connector 272 and a pad-eye shackle 280 movably attached to the pad-eye track 275, and a plurality of alignment pin receivers 285 disposed near the receiver connection end 265. In certain embodiments, angle connector 272 may be welded to the substantially U-shaped gooseneck pipe member 255. One of ordinary skill in the art will recognize that pad-eye track 275 may be fixedly attached to any side of U-shaped gooseneck pipe member 255 in accordance with one or more embodiments of the present invention.

Each hands-free gooseneck 250 may be removably attached to the hands-free gooseneck receiver 220 by lowering each hands-free gooseneck 250 into a lockable gooseneck receiver 225, using the plurality of alignment pins 245 and the plurality of alignment pin receivers 285 to ensure proper alignment, and then rotating the rotatable locking collar 240 to lock the hands-free gooseneck 250 to the hands-free gooseneck receiver 220 in a locked position. A first end (not shown) of a flexible flow hose (not shown) may be fluidly connected to the hose connection end 260 of each hands-free gooseneck 250 and a second end (not shown) of the flexible flow hose (not shown) may be fluidly connected to equipment disposed on a surface of floating vessel (e.g., 180 of FIG. 1B).

Figure 2B:
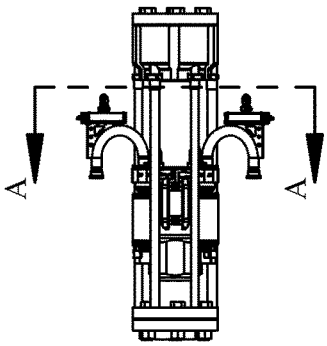
FIG. 2B shows a top plan view of a hands-free gooseneck flow spool in accordance with one or more embodiments of the present invention.
Figure 2B:
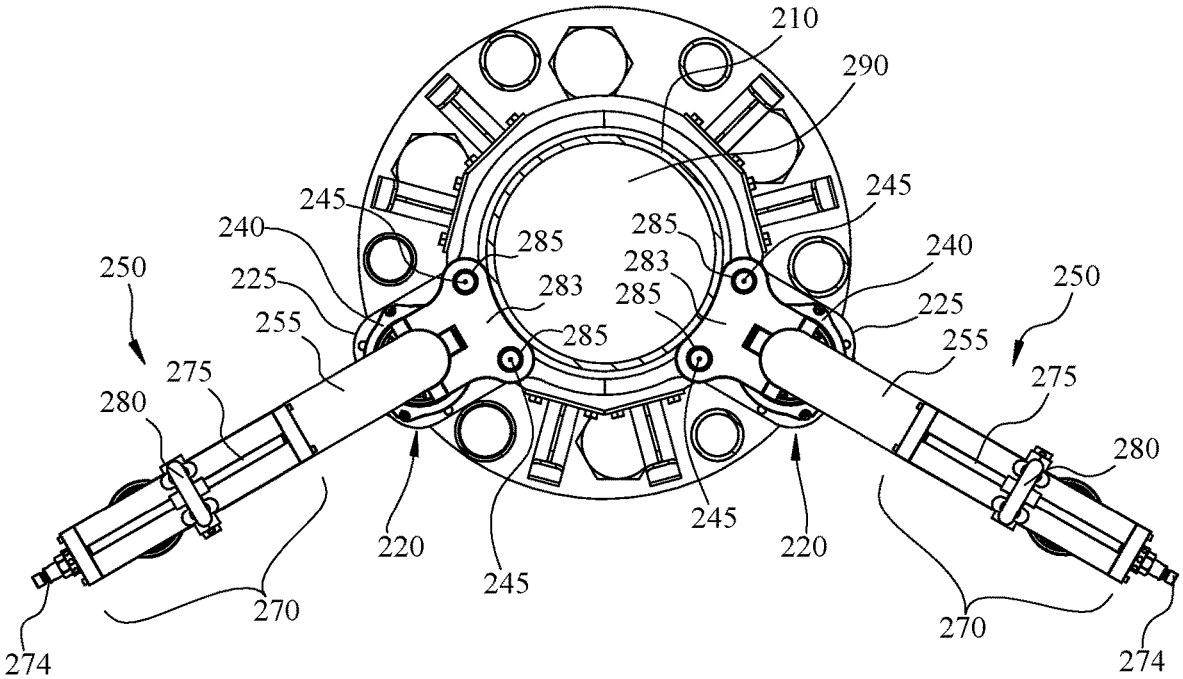

Continuing, FIG. 2B shows a top plan view of a hands-free gooseneck flow spool 200 in accordance with one or more embodiments of the present invention. The hands-free connection system 270 of each hands-free gooseneck 250 allows a rig hand (not shown) to use a hoisting system (not shown) to attach the hands-free gooseneck 250 to the hands-free gooseneck receiver 220 in a fast, efficient, and safe manner that simplifies alignment and does not require rotating or otherwise manipulating the substantially U-shaped gooseneck pipe member 255. Each hands-free gooseneck 250 is lowered such the receiver connection end 265 is inserted into the lockable gooseneck receiver 225. The plurality of alignment pin receivers 285 receive the plurality of alignment pins 245 when the hands-free gooseneck 250 is properly aligned with respect to the lockable gooseneck receiver 225. So long as the rotatable locking collar 240 is in the unlocked position, the hands-free gooseneck 250, properly aligned, should be received by the lockable gooseneck receiver 225, described in more detail herein.

Figure 3A:
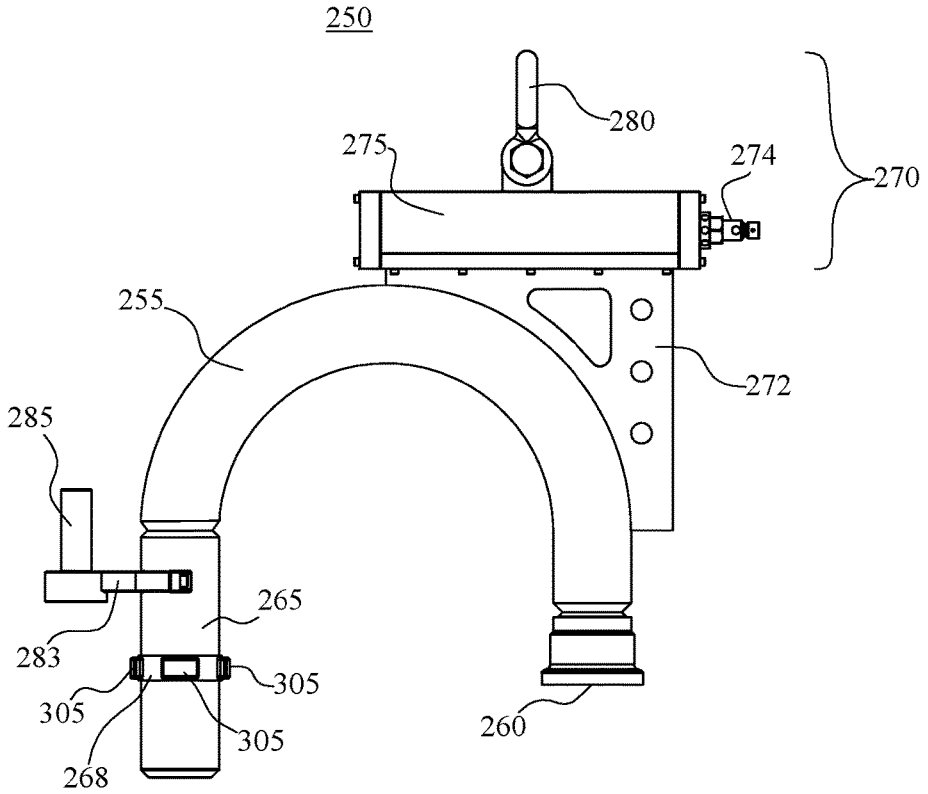
FIG. 3A shows a left-side elevation view of a hands-free gooseneck in accordance with one or more embodiments of the present invention.
Figure 3B:
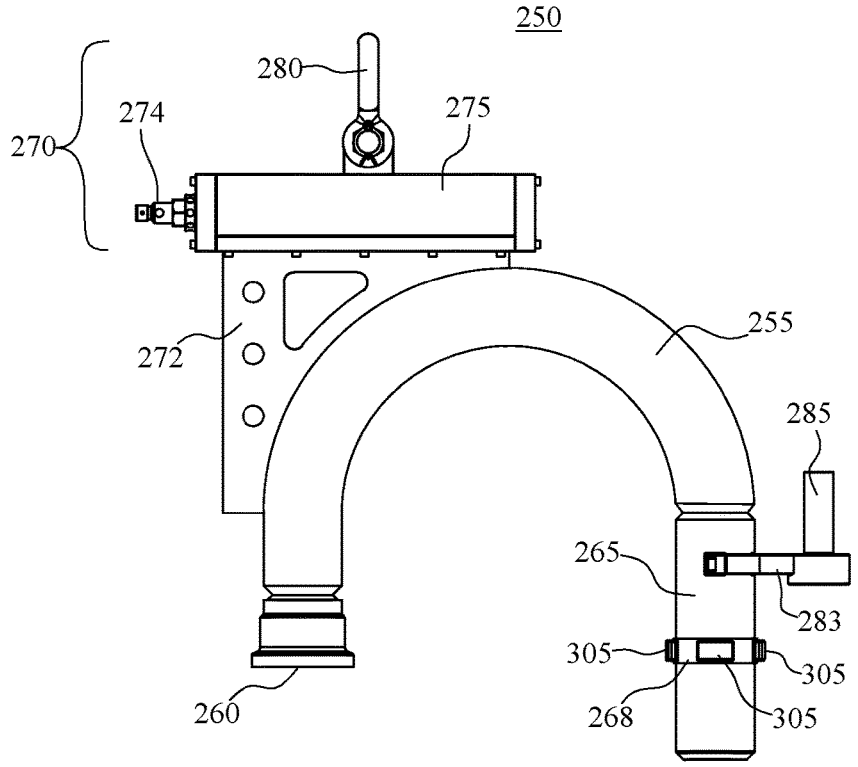
FIG. 3B shows a right-side elevation view of a hands-free gooseneck in accordance with one or more embodiments of the present invention.

FIG. 3A shows a left-side elevation view of a hands-free gooseneck 250 in accordance with one or more embodiments of the present invention. Hands-free connection system 270 may be fixedly attached to the U-shaped gooseneck pipe member 255 by angle connector 272 such that hands-free connection system 270 is substantially level with respect to the alignment base 283 of the plurality of alignment pin receivers 285 that is fixedly attached to the receiver connection end 265 of hands-free gooseneck 250. The placement of hands-free connection system 270 and angle connector 272 relative to U-shaped gooseneck pipe member 255 may vary based on an application or design to balance the weight distribution of hands-free gooseneck 250, which may assist in hoisting and lowering hands-free gooseneck 250 during hands-free gooseneck flow spool 200 assembly operations. Adjustment pin 274 of hands-free connection system 270 may be axially rotated to move pad-eye shackle 280 relative to pad-eye track 275. Continuing, FIG. 3B shows a right-side elevation view of the hands-free gooseneck 250 in accordance with one or more embodiments of the present invention.

Figure 3C:
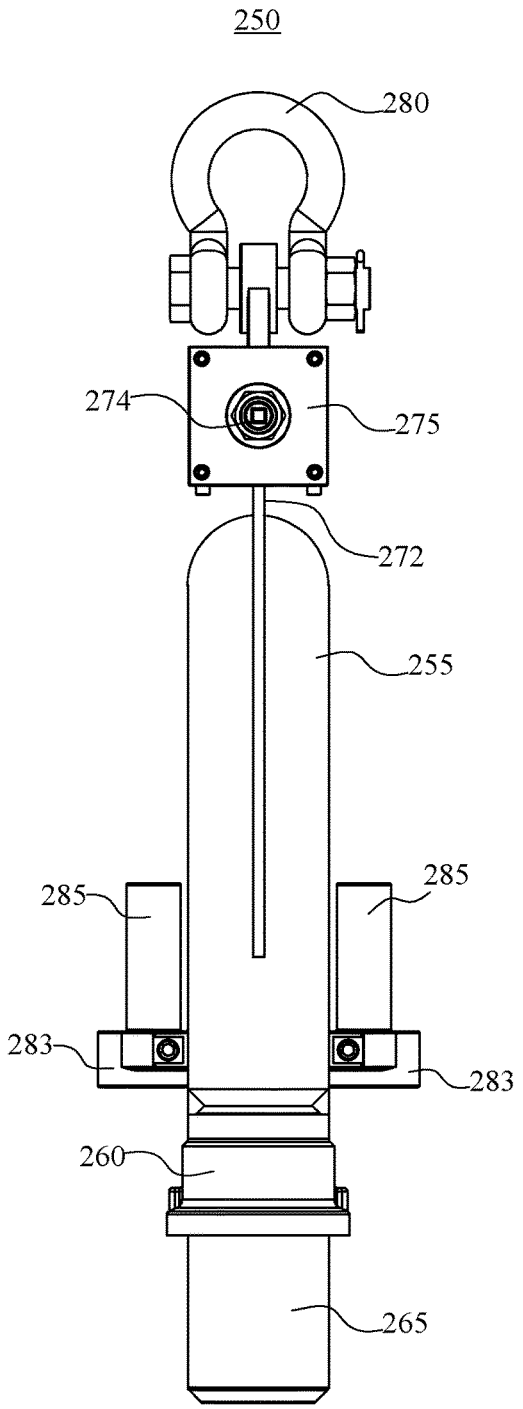
FIG. 3C shows a front elevation view of a hands-free gooseneck in accordance with one or more embodiments of the present invention.
Figure 3D:
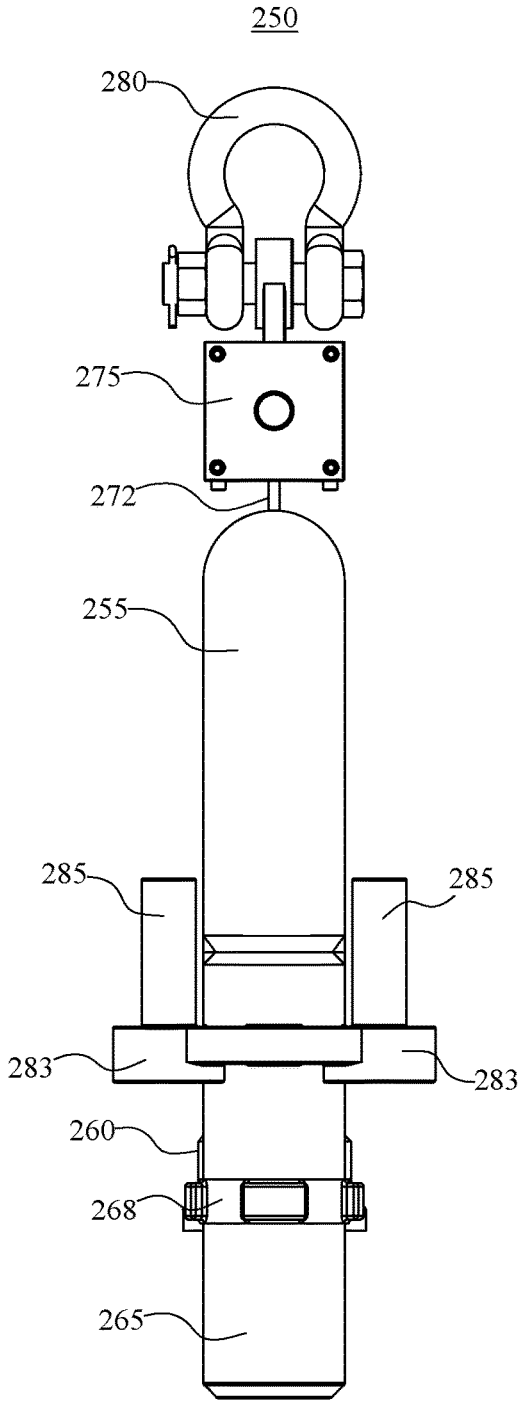
FIG. 3D shows a rear elevation view of a hands-free gooseneck in accordance with one or more embodiments of the present invention.

Continuing, FIG. 3C shows a front elevation view of hands-free gooseneck 250 in accordance with one or more embodiments of the present invention. As shown, pad-eye shackle 280 may comprise a shackle or other connector that permits attaching a hoisting cable (not shown) to hands-free gooseneck 250. Continuing, FIG. 3D shows a rear elevation view of hands-free gooseneck 250 in accordance with one or more embodiments of the present invention. As shown, the plurality of alignment pin receivers 285 may be disposed on alignment base 283 that is fixedly attached to the receiver connection end 265 of hands-free gooseneck 250. While the placement of the plurality of alignment pin receivers 285 relative to receiver connection end 265 ensures proper alignment, one of ordinary skill in the art will recognize the placement and number of alignment pin receivers 285 may vary based on an application or design in accordance with one or more embodiments of the present invention. Receiver connection end 265 may include a fixed locking collar 268 comprising a plurality of protrusions 305. One of ordinary skill in the art will recognize that the number and orientation of the protrusions 305 may vary based on an application or design in accordance with one or more embodiments of the present invention.

Figure 3F:
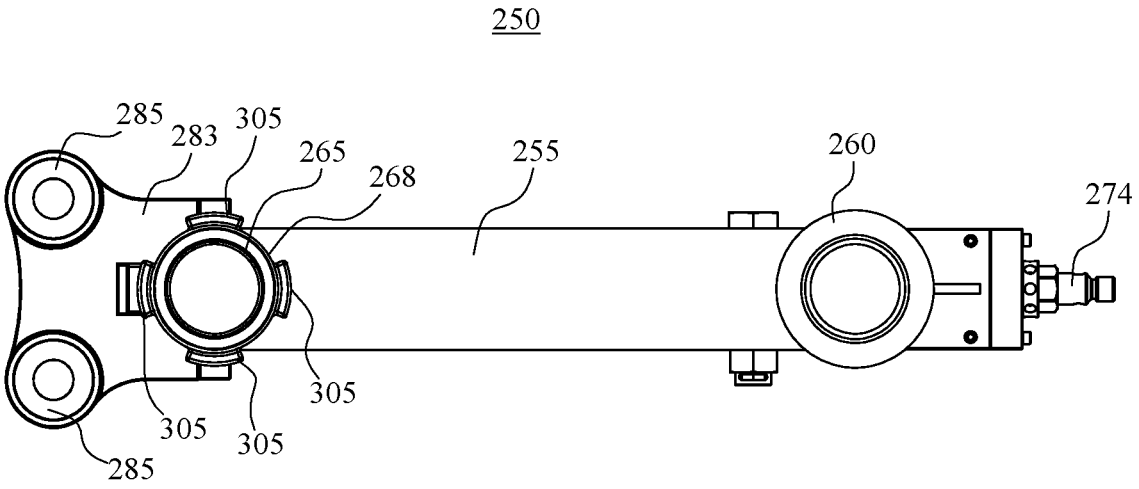
FIG. 3F shows a bottom plan view of a hands-free gooseneck in accordance with one or more embodiments of the present invention.
Figure 3E:
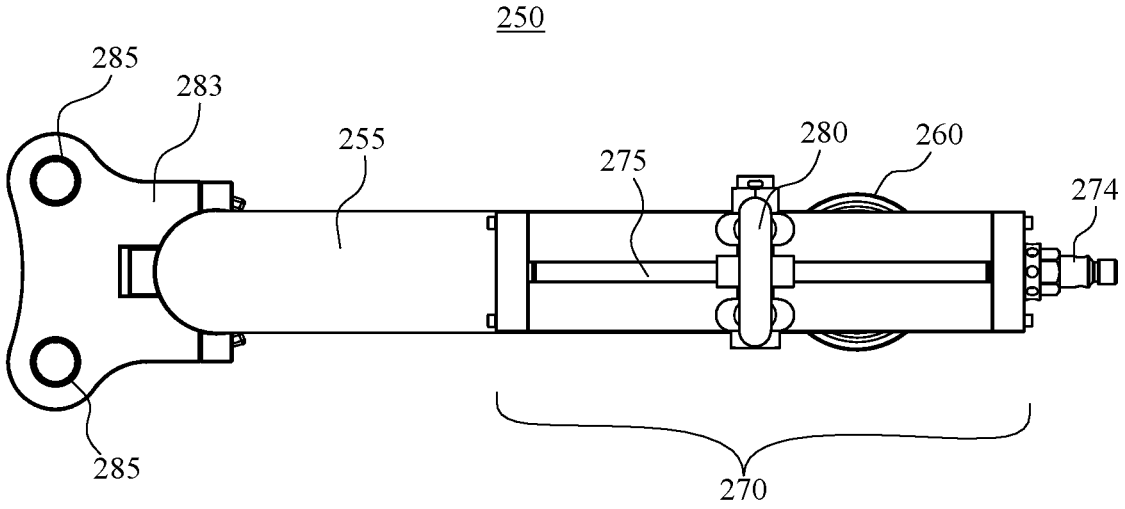
FIG. 3E shows a top plan view of a hands-free gooseneck in accordance with one or more embodiments of the present invention.

Continuing, FIG. 3E shows a top plan view of hands-free gooseneck 250 in accordance with one or more embodiments of the present invention. Pad-eye shackle 280 is movable attached to pad-eye track 275, such that a location of pad-eye shackle 280 relative to hands-free gooseneck 250 may be adjusted by way of adjustment pin 274. Continuing, FIG. 3F shows a bottom plan view of hands-free gooseneck 250 in accordance with one or more embodiments of the present invention. As previously discussed, fixed locking collar 268 may include a plurality of protrusions 305 that facilitate attaching and securing hands-free gooseneck 250 to hands-free gooseneck receiver (e.g., 220) as described in more detail herein.

Figure 3G:
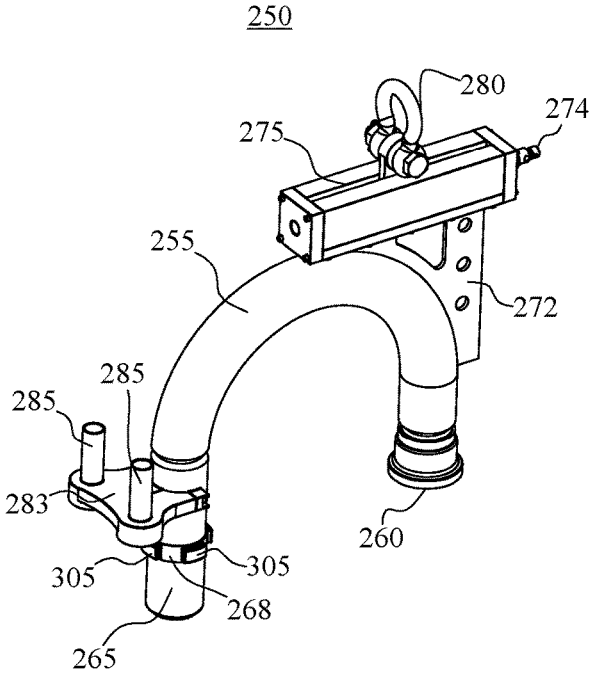
FIG. 3G shows a rear-facing left-side perspective view of a hands-free gooseneck in accordance with one or more embodiments of the present invention.
Figure 3H:
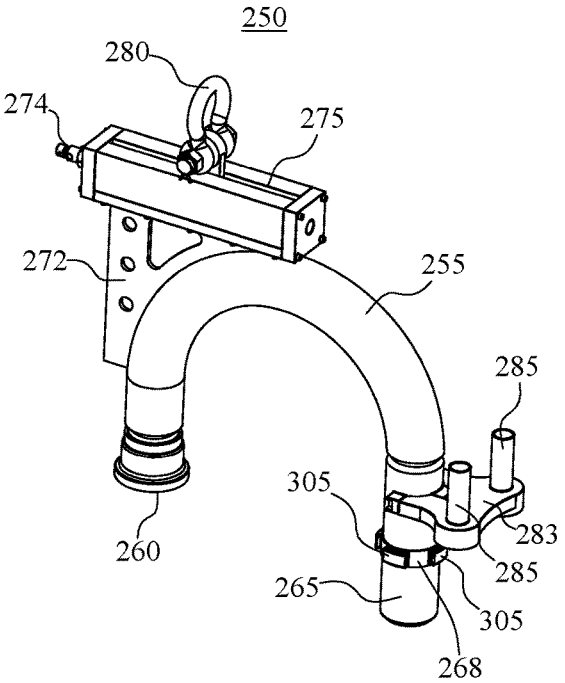
FIG. 3H shows a rear-facing right-side perspective view of a hands-free gooseneck in accordance with one or more embodiments of the present invention.
Figure 3I:
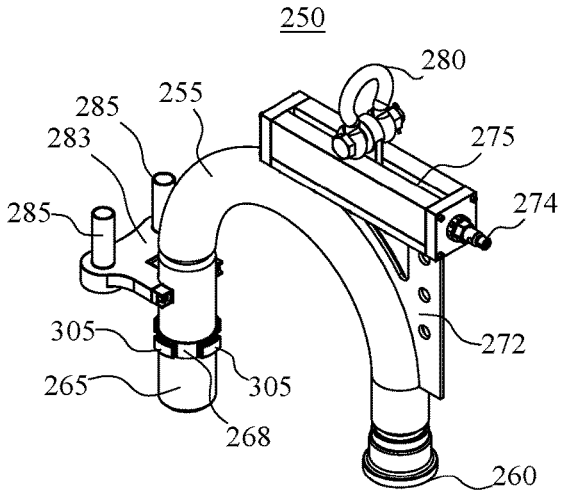
FIG. 3I shows a front-facing left-side perspective view of a hands-free gooseneck in accordance with one or more embodiments of the present invention.
Figure 3J:
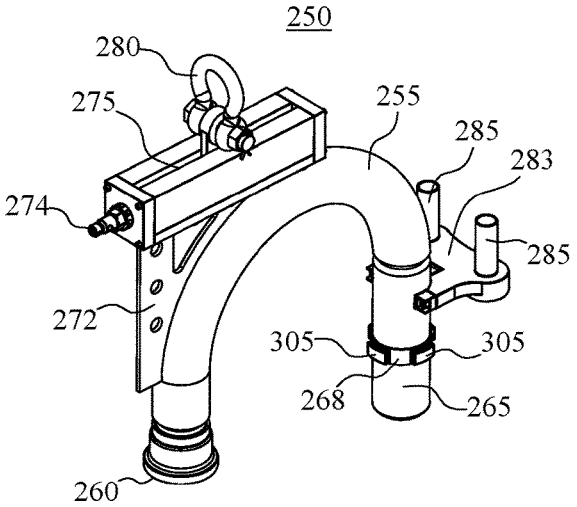
FIG. 3J shows a front-facing right-side perspective view of a hands-free gooseneck in accordance with one or more embodiments of the present invention.

Continuing, FIG. 3G shows a rear-facing left-side perspective view of hands-free gooseneck 250 in accordance with one or more embodiments of the present invention. Continuing, FIG. 3H shows a rear-facing right-side perspective view of hands-free gooseneck 250 in accordance with one or more embodiments of the present invention. Continuing, FIG. 3I shows a front-facing left-side perspective view of hands-free gooseneck 250 in accordance with one or more embodiments of the present invention. Continuing, FIG. 3J shows a front-facing right-side perspective view of hands-free gooseneck 250 in accordance with one or more embodiments of the present invention.

Figure 4:
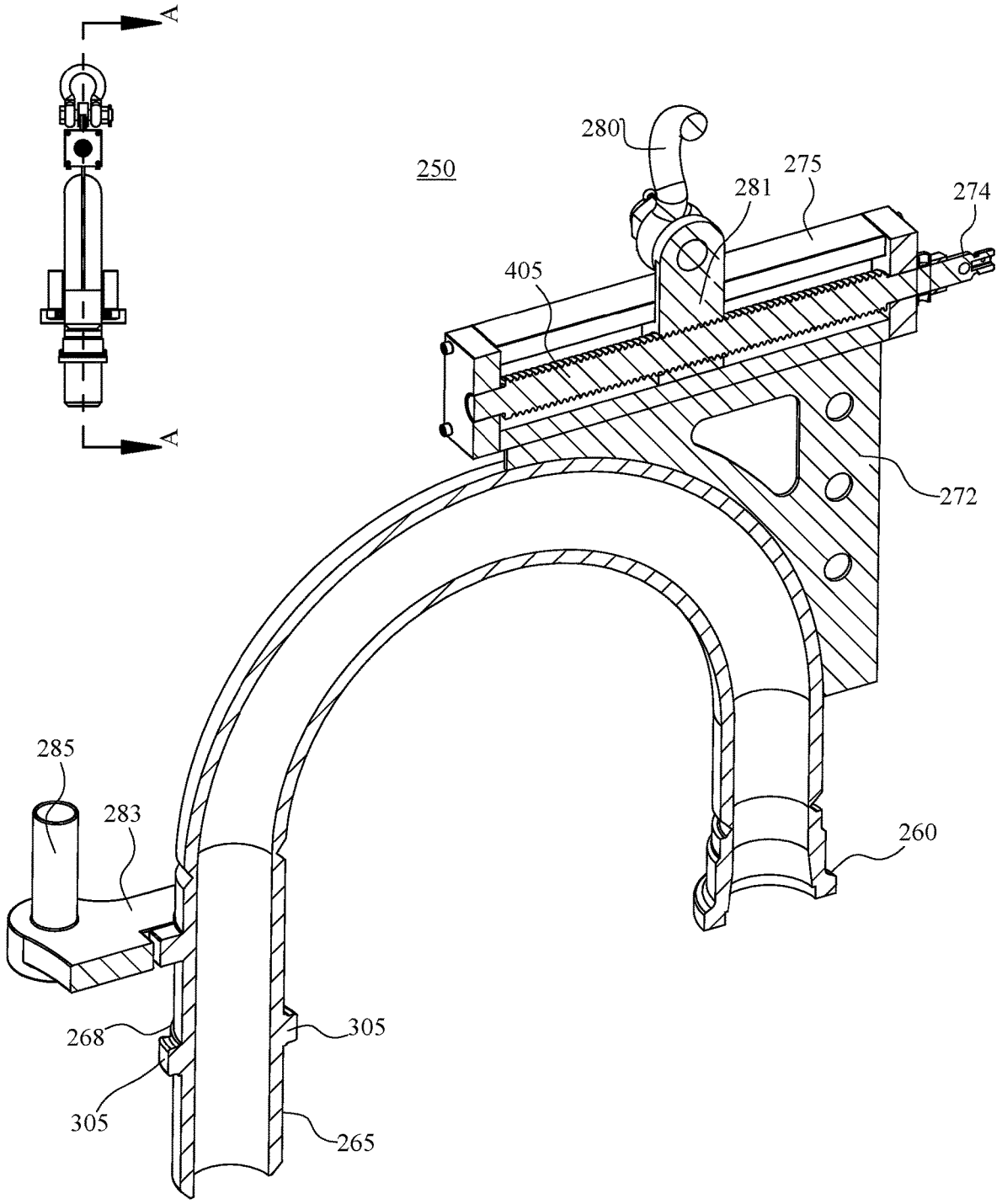
FIG. 4 shows a rear-facing left-side cross-sectional perspective view of a hands-free gooseneck in accordance with one or more embodiments of the present invention.

FIG. 4 shows a rear-facing left-side cross-sectional perspective view of a hands-free gooseneck 250 in accordance with one or more embodiments of the present invention. Hose connection end 260 may be fluidly connected to receiver connection end 265. Receiver connection end 265 may be fluidly connected to the central lumen (not shown) of the mandrel (e.g., 210 of FIG. 2A). A flexible hose (not shown) may fluidly connect hose connection end 260 to a mud-gas-separator, shale shaker, or other fluids processing system (not shown) disposed on the surface of the floating vessel (e.g., 180 of FIG. 1B). Hands-free connection system 270 may include a pad-eye track 275 and a pad-eye shackle 280 movably attached to pad-eye track 275 by way of pad-eye connector 281 and threaded axial rail 405.

Figure 5:
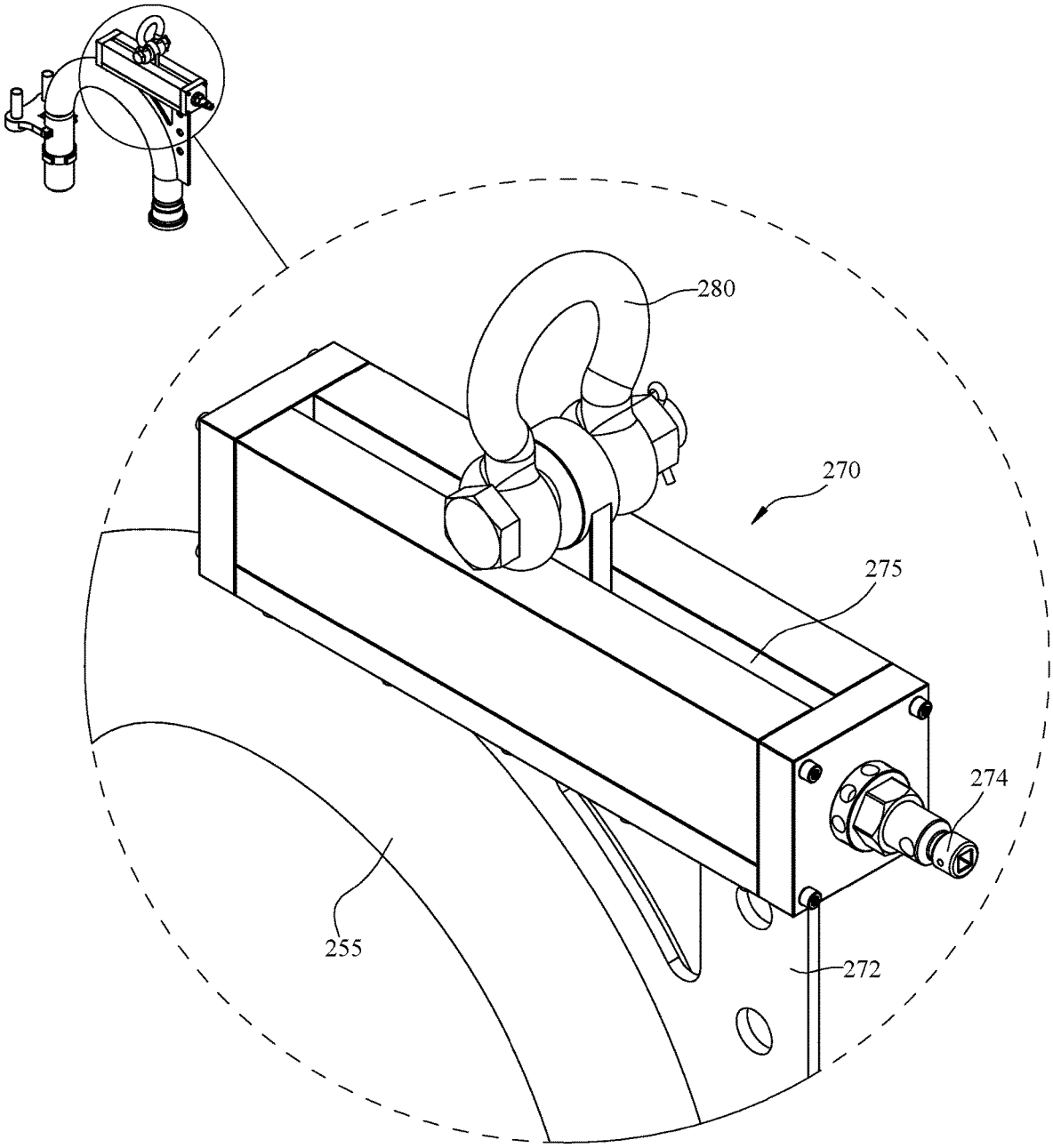
FIG. 5 shows a front-facing detailed perspective view of a hands-free connection system in accordance with one or more embodiments of the present invention.

FIG. 5 shows a front-facing detailed perspective view of a hands-free connection system 270 in accordance with one or more embodiments of the present invention. Hands-free connection system 270 may include a pad-eye track 275 disposed on U-shaped gooseneck pipe member 255 and a pad-eye shackle 280 movably attached to pad-eye track 275. The pad-eye track 275 may comprise a threaded axial rail (e.g., 405 of FIG. 4) and the pad-eye connector 281 of pad-eye shackle 280 may be movably attached to the threaded axial rail 405. Rotation of adjustment pin 274 in a first direction causes pad-eye connector 281 and pad-eye shackle 280 to move a direction while rotation of adjustment pin 274 in a second direction causes pad-eye connector 281 and pad-eye shackle 280 to move in another direction.

Figure 6A:
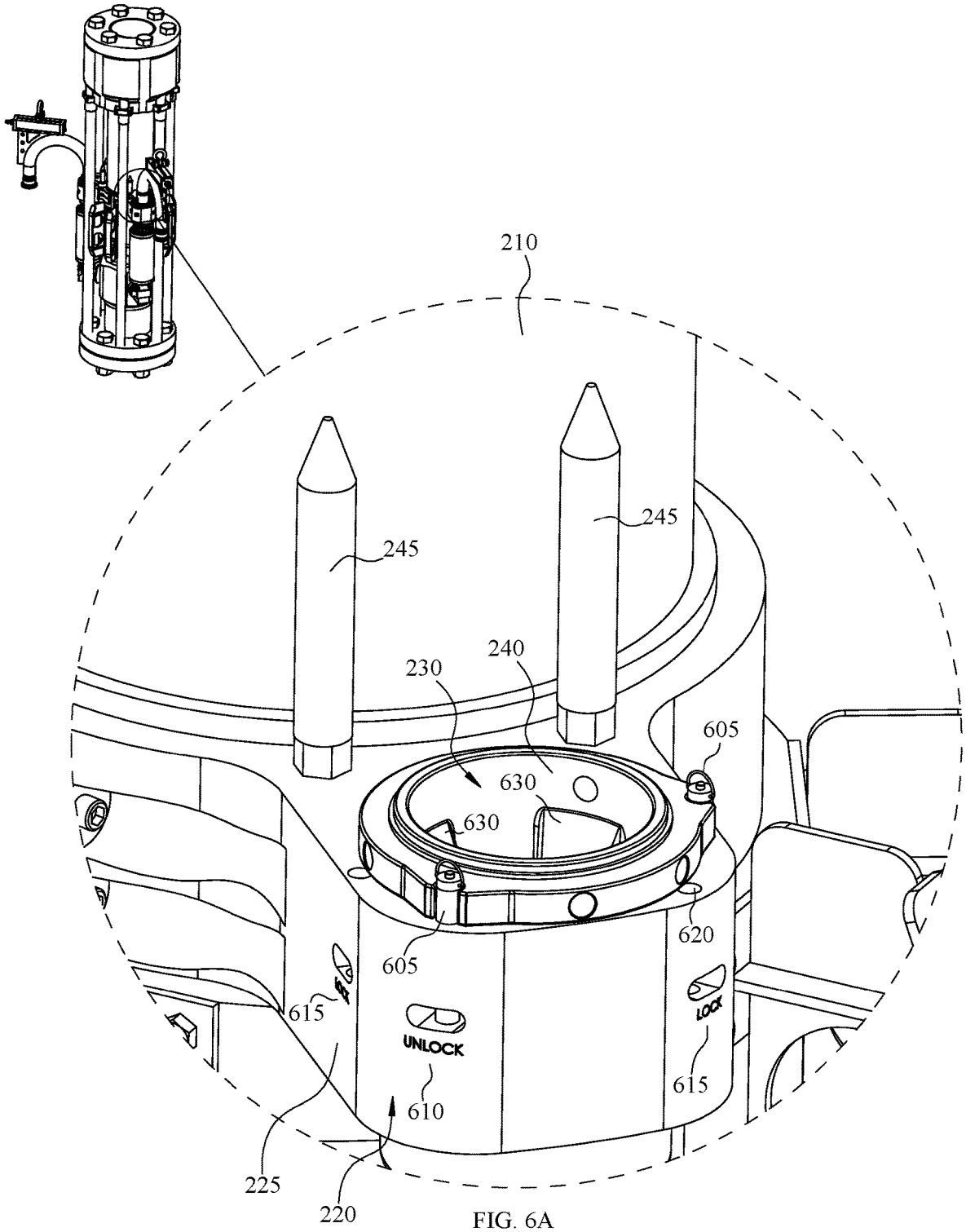
FIG. 6A shows a detailed perspective view of a hands-free gooseneck receiver in an unlocked position in accordance with one or more embodiments of the present invention.

FIG. 6A shows a detailed perspective view of a hands-free gooseneck receiver 220 in an unlocked position in accordance with one or more embodiments of the present invention. Hands-free gooseneck receiver 220 may be fixedly attached to mandrel 210. Hands-free gooseneck receiver 220 may include lockable gooseneck receiver 225 that includes gooseneck receiver end 230 that is fluidly connected to the mandrel connection end (not shown). A plurality of alignment pins 245 may be disposed behind gooseneck receiver end 230 nearer mandrel 210 to facilitate alignment of the hands-free gooseneck (e.g., 250) as it is being lowered into hands-free gooseneck receiver 220. Rotatable locking collar 240 may be at least partially disposed within gooseneck receiver end 230. Rotatable locking collar may include a plurality of protrusions 630. In the unlocked state, a plurality of pins 605 may disposed in a corresponding plurality of unlocked pin slots (e.g., 625 of FIG. 6B) such that an orientation of the plurality of protrusions 630 are offset relative to the plurality of protrusions (e.g., 305) of the fixed locking collar (e.g., 268) of the hands-free gooseneck (e.g., 250), permitting the receiver connection end (e.g., 265) of hands-free gooseneck (e.g., 250) to be fully inserted into hands-free gooseneck receiver 220.

Figure 6B:
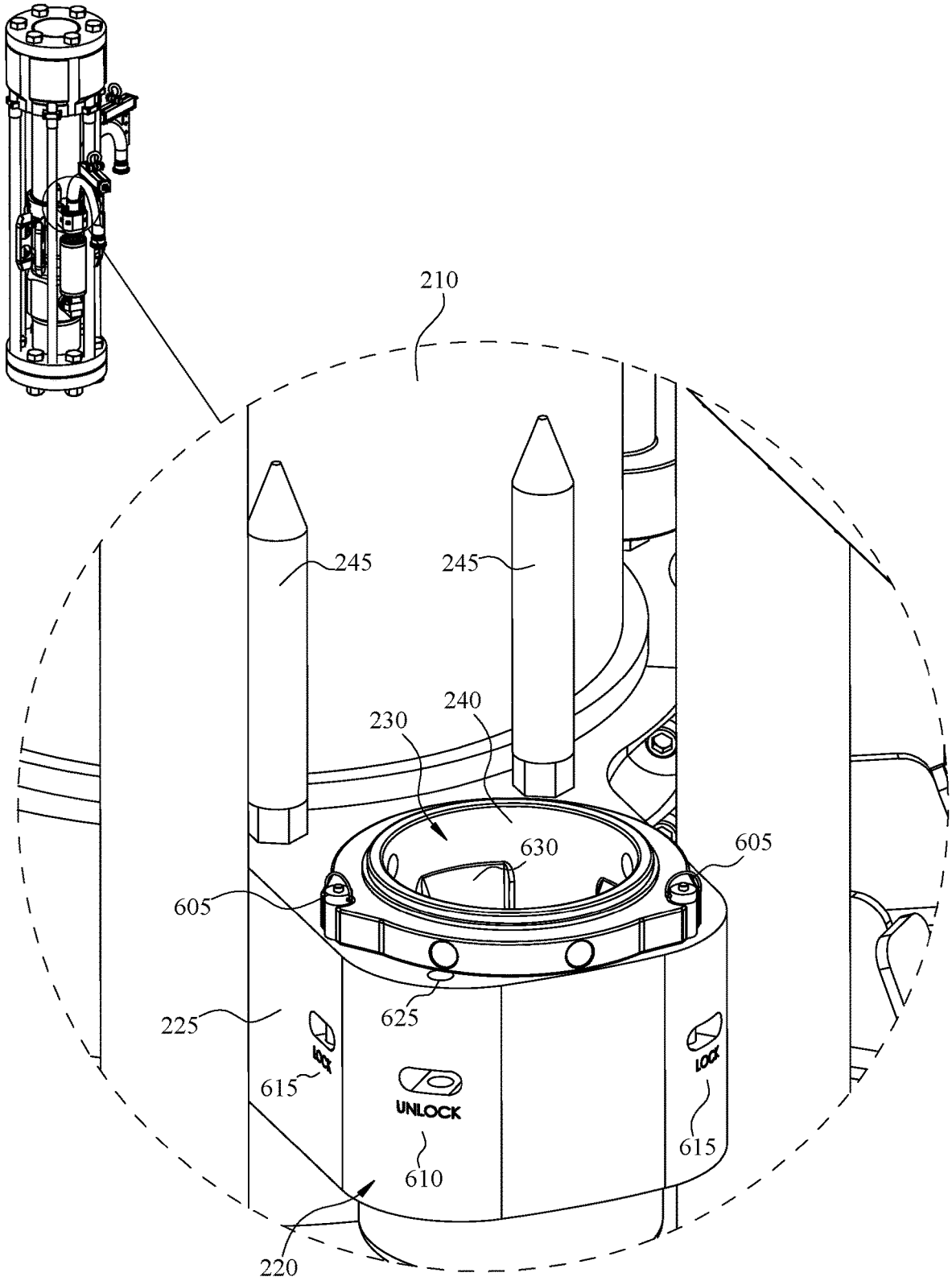
FIG. 6B shows a detailed perspective view of a hands-free gooseneck receiver in a locked position in accordance with one or more embodiments of the present invention.

Continuing, FIG. 6B shows a detailed perspective view of a hands-free gooseneck receiver 220 in a locked position in accordance with one or more embodiments of the present invention. After the hands-free gooseneck (e.g., 250) is aligned and lowered into hand-free gooseneck receiver 225, pins 605 may be removed from unlocked pin slots 625 and rotatable locking collar 240 may be rotated such that the plurality of protrusions 630 are rotated relative to, and disposed above, the plurality of protrusions (e.g., 305) of the fixed locking collar (e.g., 268) of the hands-free gooseneck (e.g., 250). The plurality of pins 605 may then be inserted into the corresponding plurality of locked pin slots 620, thereby securing the hands-free gooseneck (e.g., 250) to hands-free gooseneck receiver 220.

Figure 7A:
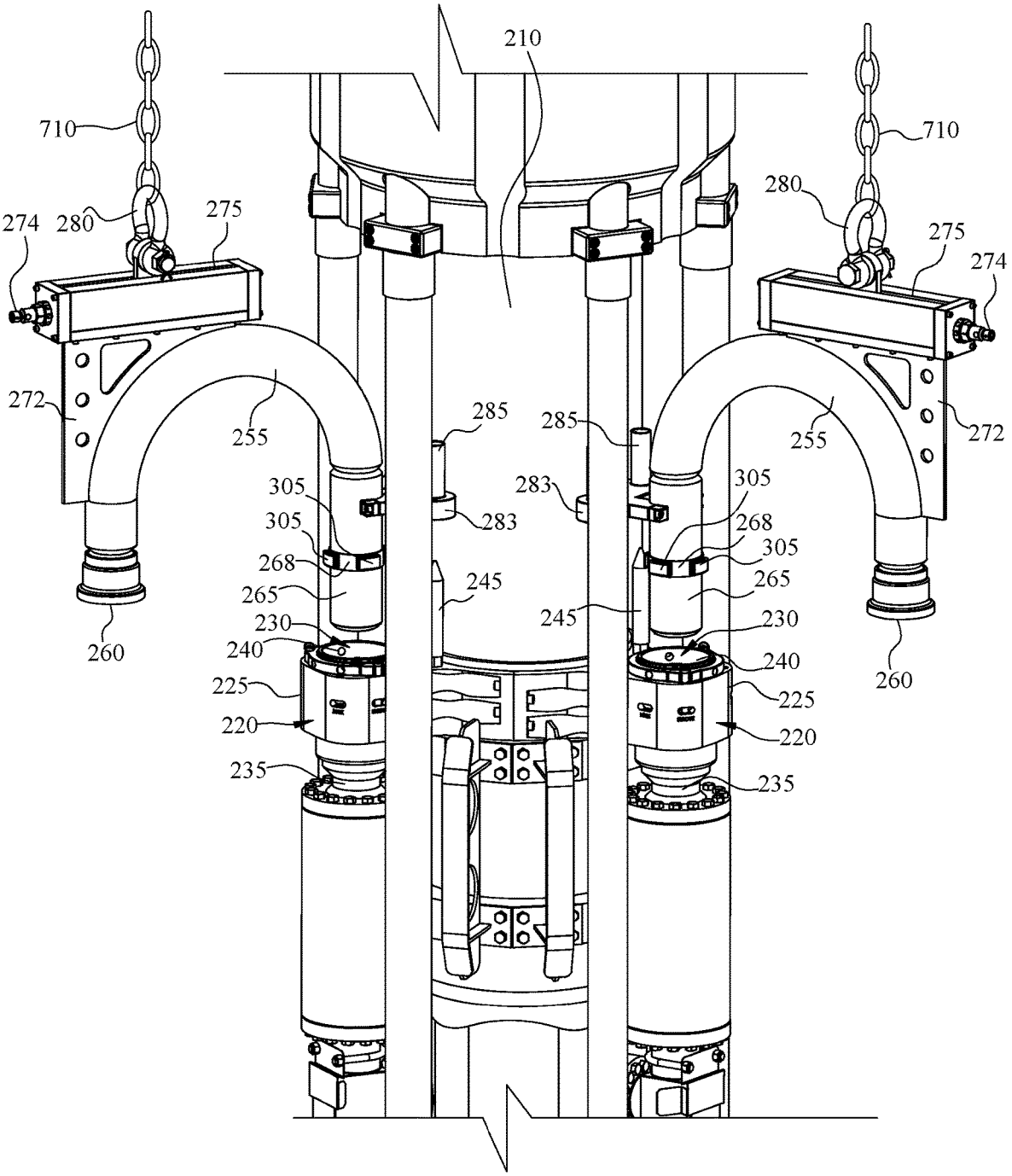
FIG. 7A shows an environmental view of a plurality of hands-free goosenecks being lowered into a plurality of hands-free gooseneck receivers in accordance with one or more embodiments of the present invention.

FIG. 7A shows an environmental view of a plurality of hands-free goosenecks 250 being lowered into a plurality of hands-free gooseneck receivers 220 in accordance with one or more embodiments of the present invention. A plurality of cables 710 of a hoisting system (not shown) may be removably attached to the pad-eye shackles 280 of the hands-free connection systems (e.g., 270) of the hands-free goosenecks 250. Flexible hoses (not shown) may be attached to the plurality of hose connection ends 260 while hands-free goosenecks 250 are supported by the hoisting system (not shown) or after attachment of hands-free goosenecks 250 to hands-free gooseneck receivers 220. A rig hand (not shown) working from a basket (i.e., 185 of FIG. 1B) may adjust the location of one or both pad-eye shackles 280 with adjustment pins 274, to level hands-free goosenecks 250 prior to lowering. Once leveled, the driller (not shown) may lower hands-free goosenecks 250 with the hoisting system (not shown) while the rig hand (not shown) cooperatively facilitates aligning hands-free goosenecks 250 with hands-free gooseneck receivers 220. The plurality of alignment pin receivers 285 of each hands-free gooseneck 250 may be aligned with the plurality of alignment pins 245 of each hands-free gooseneck receiver 250 and the plurality of receiver connection ends 265 may be aligned with the plurality of gooseneck receiver ends 230. The plurality of rotatable locking collars 240 may be in the unlocked position during lowering operations.

Figure 7B:
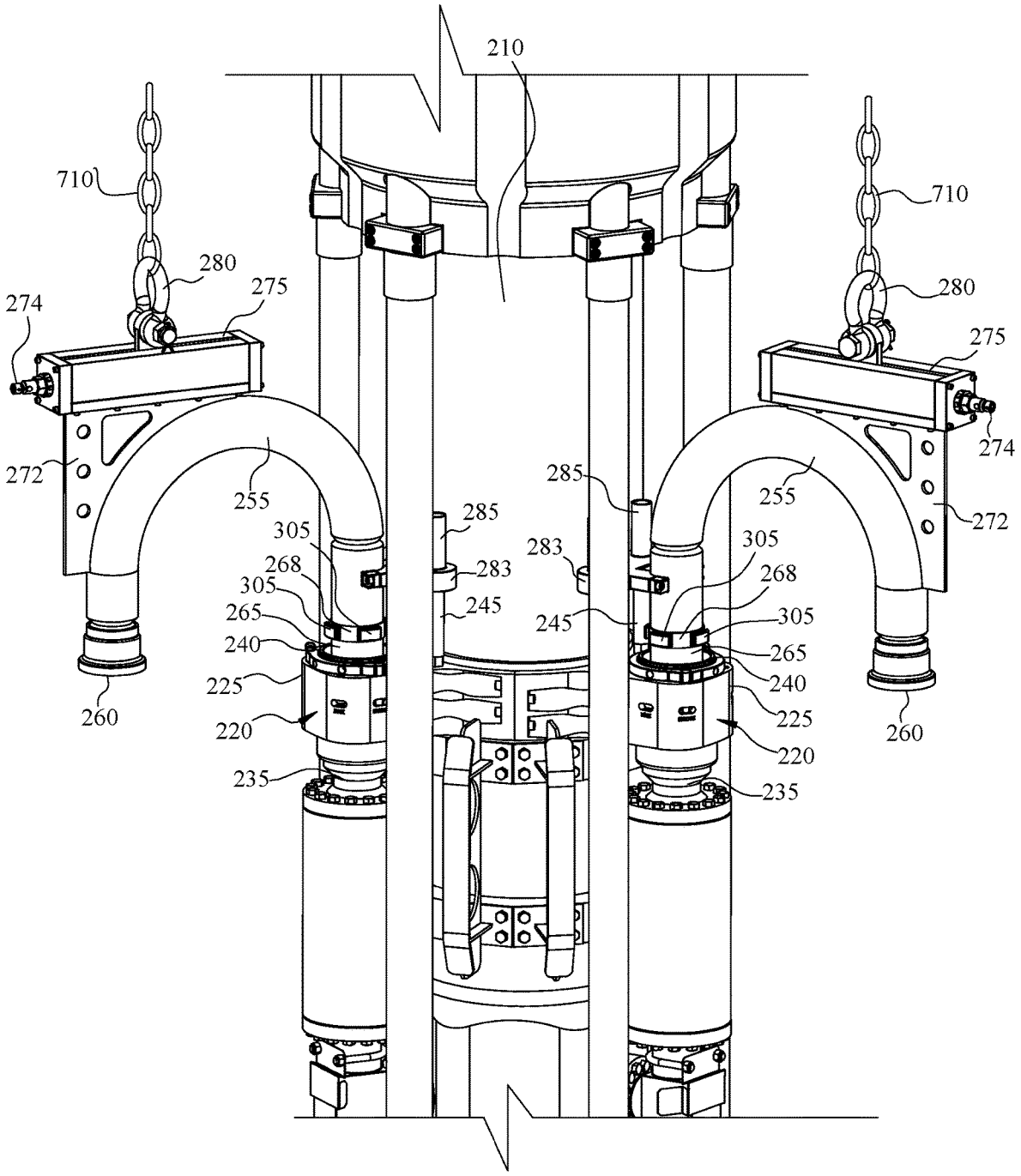
FIG. 7B shows an environmental view of a plurality of hands-free goosenecks being further lowered into a plurality of hands-free gooseneck receivers in accordance with one or more embodiments of the present invention.

Continuing, FIG. 7B shows an environmental view of a plurality of hands-free goosenecks 250 being further lowered into a plurality of hands-free gooseneck receivers 220 in accordance with one or more embodiments of the present invention. While the plurality of hands-free goosenecks 250 are being lowered, the plurality of alignment pins 245 are inserted into the plurality of alignment pin receivers 285 and the plurality of receiver connection ends 265 are inserted into the plurality of gooseneck receiver ends 230. When rotatable locking collar 240 is in the unlocked position, the plurality of protrusions (e.g., 630) of hands-free gooseneck receivers 250 are offset relative to the plurality of protrusions (e.g., 305) of fixed locking collars 268 of the hands-free goosenecks 250, permitting receiver connection ends 265 to be fully inserted into gooseneck receiver ends 230. When fully inserted the plurality of protrusions (e.g., 305) of fixed locking collars 268 may be disposed below the plurality of protrusions (e.g., 630) of rotatable locking collars 240.

Figure 7C:
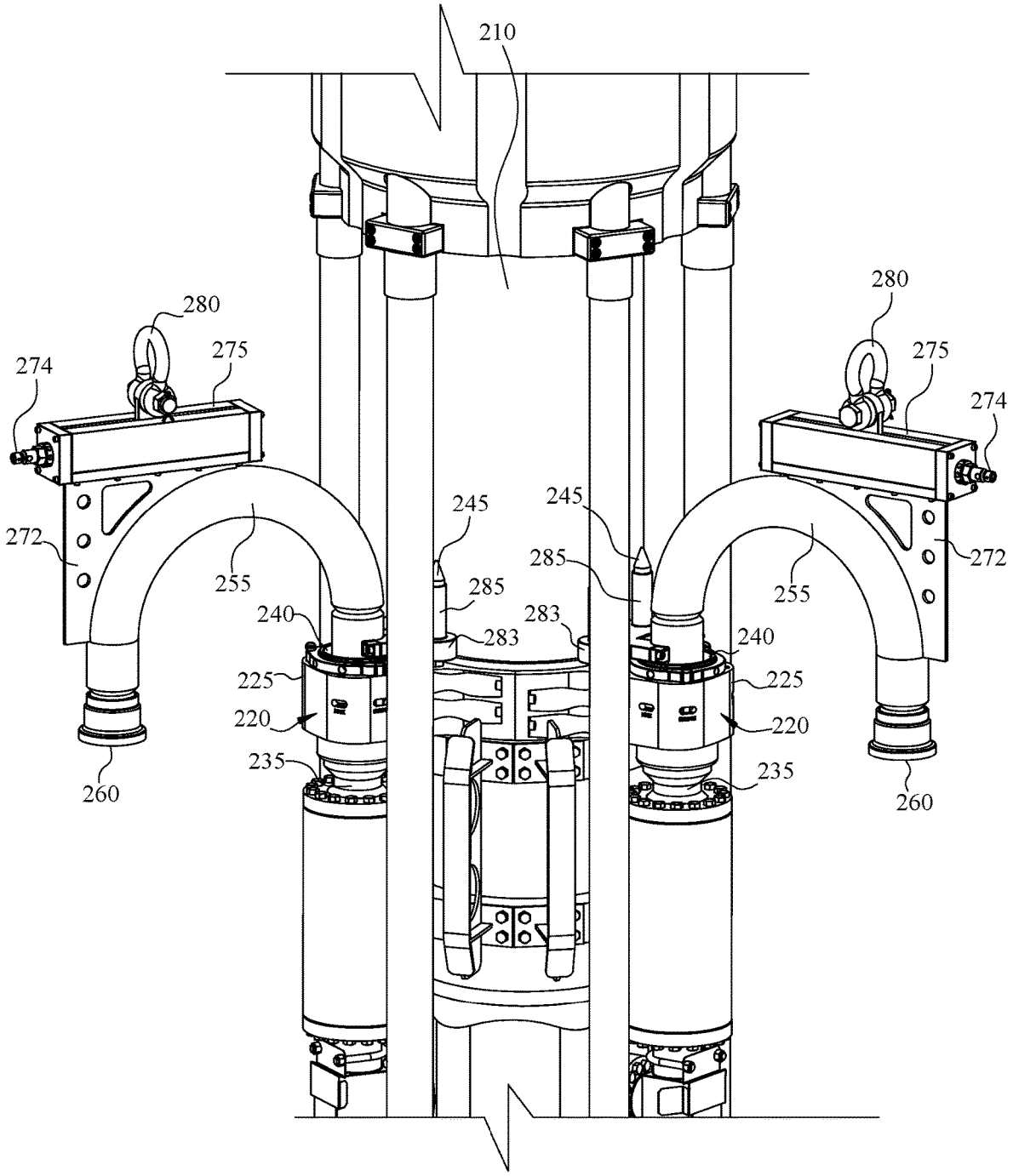
FIG. 7C shows an environmental view of a plurality of hands-free goosenecks fully lowered into a plurality of hands-free gooseneck receivers in accordance with one or more embodiments of the present invention.

Continuing, FIG. 7C shows an environmental view of a plurality of hands-free goosenecks 220 fully lowered into a plurality of hands-free gooseneck receivers 250 in accordance with one or more embodiments of the present invention. When properly aligned, the plurality of alignment pins 245 are inserted into the plurality of alignment pin receivers 285 and the plurality of receiver connection ends 265 are fully inserted into the plurality of gooseneck connection ends 230. At this time, the chains (e.g., 710) may be detached and the rig hand (not shown) working from the basket (e.g., 185 of FIG. 1B) may secure the hands-free gooseneck receivers 220 in place.

Figure 7D:
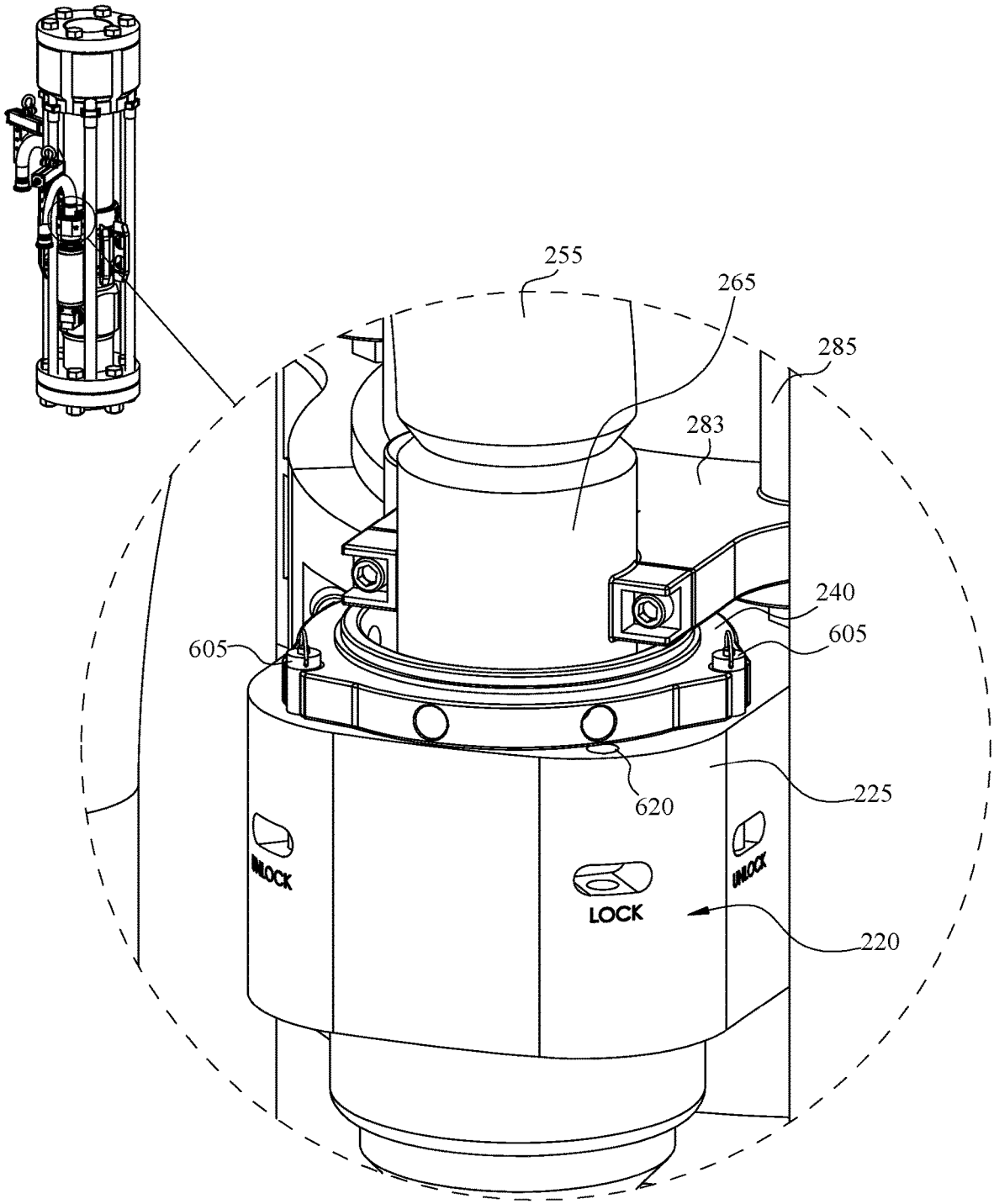
FIG. 7D shows detailed environmental view of a rotatable locking collar in an unlocked position in accordance with one or more embodiments of the present invention.
Figure 7E:
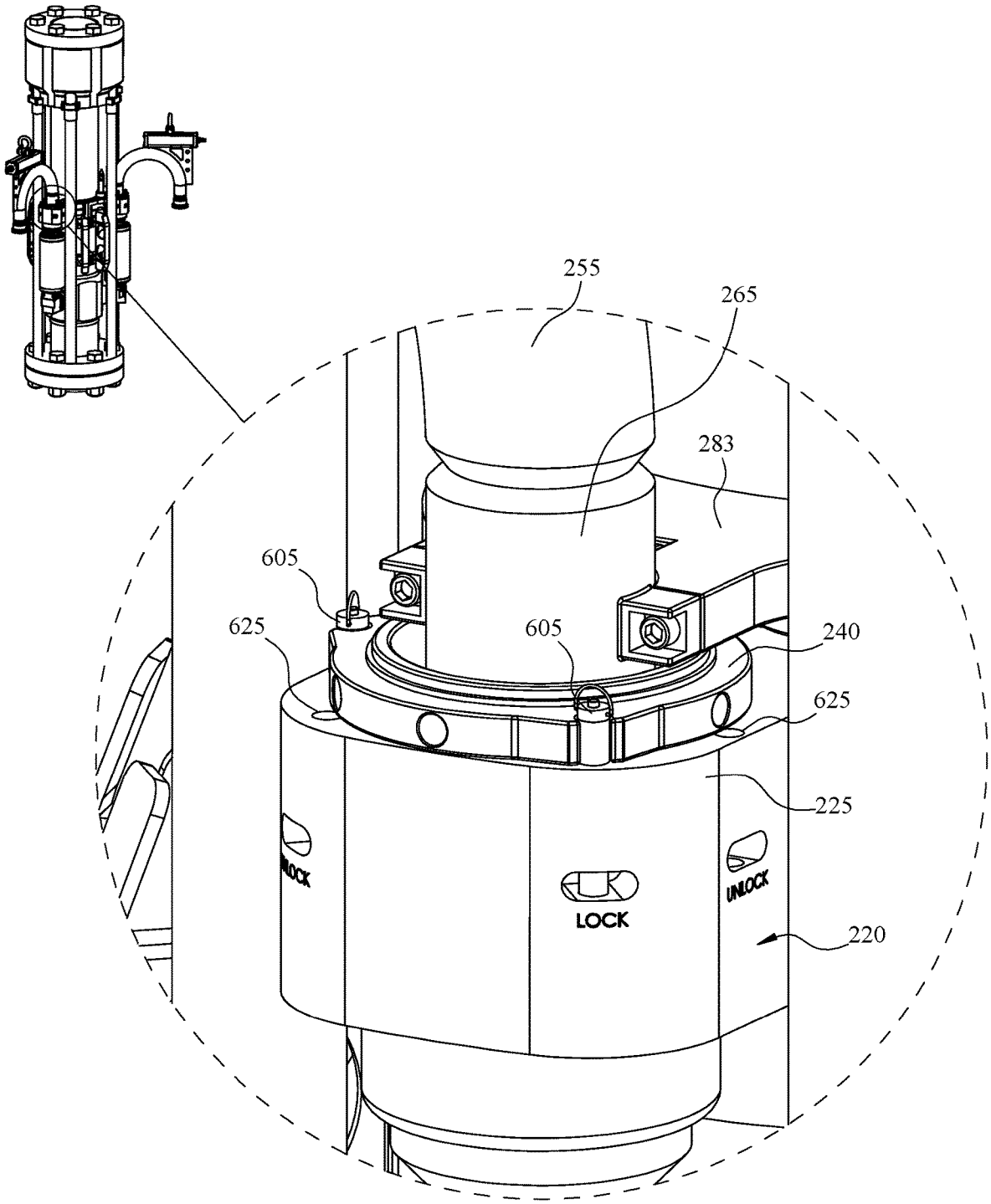
FIG. 7E shows detailed environmental view of a rotatable locking collar in a locked position in accordance with one or more embodiments of the present invention.

Continuing, FIG. 7D shows a detailed environmental view of a rotatable locking collar 240 in an unlocked position in accordance with one or more embodiments of the present invention. Once receiver connection end 265 is fully inserted into gooseneck receiver end 230, a rig hand (not shown) working from the basket (e.g., 185) may remove the plurality of pins 605 from the plurality of unlocked pin slots (e.g., 625) and rotate rotatable locking collar 240 from the unlocked to the locked position using only hand strength. Advantageously, the rig hand (not shown) is not required to rotate hands-free gooseneck 250 or use substantial force in an awkward position working from the basket (e.g., 185 of FIG. 1B) while disposed over the open ocean in the moon pool (e.g., 170 of FIG. 1B) area of the floating vessel (e.g., 180 of FIG. 1B). Continuing, FIG. 7E shows detailed environmental view of a rotatable locking collar 240 in a locked position in accordance with one or more embodiments of the present invention. When in the locked position, the plurality of protrusions (e.g., 630) of rotatable locking collar 240 are substantially aligned and disposed above the plurality of protrusions (e.g., 305) of fixed locking collar (e.g., 268). The rig hand (not shown) working from the basket (e.g., 185) may insert the plurality of pins 605 into the plurality of locked pin slots (e.g., 620) to secure hands-free gooseneck 250 to hands-free gooseneck receiver 250.

In one or more embodiments of the present invention, a hands-free gooseneck 250 may include a substantially U-shaped gooseneck pipe member 255 including a hose connection end 260 that is fluidly connected to a receiver connection end 265, a hands-free connection system 270 including a pad-eye track 275 disposed on the U-shaped gooseneck pipe member 255 and a pad-eye shackle 280 movably attached to the pad-eye track 275, and a plurality of alignment pin receivers 285 disposed near receiver connection end 265. The hose connection end 260 may comprise a connector for fluidly connecting a flexible hose. The receiver connection end 265 may include a fixed locking collar 268 comprising a plurality of protrusions 305 for aligning the hands-free gooseneck 250 while inserting the hands-free gooseneck 250 into a hands-free gooseneck receiver 220. The pad-eye track 275 may comprise a threaded axial rail 405 and the pad-eye shackle 280 may be movably attached to the threaded axial rail 405. Each alignment pin receiver 285 may comprise a sheath for receiving an alignment pin 245 disposed on a hands-free gooseneck receiver 220.

In one or more embodiments of the present invention, a hands-free gooseneck flow spool 200 may include a mandrel 210, a hands-free gooseneck receiver 220 fixedly attached to the mandrel 210, and at least one hands-free gooseneck 250 that is removably attached to the hands-free gooseneck receiver 220. The hands-free gooseneck receiver 220 may include a lockable gooseneck receiver including a gooseneck receiver end 230 fluidly connected to a mandrel connection end 235, a rotatable locking collar 240 at least partially disposed within the gooseneck receiver end 230, and a plurality of alignment pins 245. The hands-free gooseneck 250 may include a substantially U-shaped gooseneck pipe member 255 including a hose connection end 260 that is fluidly connected to a receiver connection end 265, a hands-free connection system 270 including a pad-eye track 275 disposed on the U-shaped gooseneck pipe member 255 and a pad-eye shackle 280 movably attached to the pad-eye track 275, and a plurality of alignment pin receivers 285 disposed near the receiver connection end 265. The rotatable locking collar 240 may lock the hands-free gooseneck 250 to the hands-free gooseneck receiver 220 in a locked position. The hose connection end 260 may comprise a connector for fluidly connecting a flexible hose. The receiver connection end 265 may include a fixed locking collar 268 comprising a plurality of protrusions 305 for aligning the hands-free gooseneck 250 while inserting the hands-free gooseneck 250 into a hands-free gooseneck receiver 220. The pad-eye track 275 may comprise a threaded axial rail 405 and the pad-eye shackle 280 may be movably attached to the threaded axial rail 405. Each alignment pin receiver 285 may comprise a sheath for receiving an alignment pin 245 disposed on a hands-free gooseneck receiver 220.

Advantages of one or more embodiments of the present invention may include one or more of the following:

In one or more embodiments of the present invention, a hands-free gooseneck and hands-free gooseneck flow spool simplifies and improves the safety of flow spool assembly operations that typically take place in the moon pool area of a floating vessel over open water that is prone to movement.

In one or more embodiments of the present invention, each hands-free gooseneck of a hands-free gooseneck flow spool may include a hands-free connection system that facilitates lowering the hands-free gooseneck into a hands-free gooseneck receiver with a hoisting system.

In one or more embodiments of the present invention, each hands-free gooseneck of a hands-free gooseneck flow spool may include a plurality of alignment pin receivers and the plurality of hands-free gooseneck receivers may include a corresponding plurality of alignment pins that facilitate aligning the hands-free goosenecks while they are being lowered into their respective hands-free gooseneck receivers.

In one or more embodiments of the present invention, each hands-free gooseneck receiver of a hands-free gooseneck flow spool may include a rotatable locking collar that easily rotates to lock a hands-free gooseneck into place, without requiring that the hands-free gooseneck be rotated or otherwise manipulated with substantial force to secure it in place, thereby eliminating the requirement of exerting substantial force when working from a basket in a moon pool area over open ocean of a floating vessel prone to movement.

In one or more embodiments of the present invention, a hands-free gooseneck and hands-free gooseneck flow spool simplifies the flow spool assembly process including lowering, aligning, and attaching each hands-free gooseneck to a corresponding hands-free gooseneck receiver and does not require the exertion of substantial manual force or the rotation of the gooseneck to secure each hands-free gooseneck in their respective hands-free gooseneck receiver.

In one or more embodiments of the present invention, a hands-free gooseneck and hands-free gooseneck flow spool reduces the amount of time required to perform flow spool assembly operations.

In one or more embodiments of the present invention, a hands-free gooseneck and hands-free gooseneck flow spool reduces the costs associated with performing flow spool assembly operations.

In one or more embodiments of the present invention, a hands-free gooseneck and hands-free gooseneck flow spool improves the efficiency of flow spool assembly operations.

In one or more embodiments of the present invention, a hands-free gooseneck and hands-free gooseneck flow spool improves the safety of flow spool assembly operations.

While the present invention has been described with respect to the above-noted embodiments, those skilled in the art, having the benefit of this disclosure, will recognize that other embodiments may be devised that are within the scope of the invention as disclosed herein. Accordingly, the scope of the invention should only be limited by the appended claims.

What is claimed is:

1. A hands-free gooseneck flow spool comprising:

a mandrel;

a hands-free gooseneck receiver fixedly attached to the mandrel comprising:

a lockable gooseneck receiver comprising a gooseneck receiver end fluidly connected to a mandrel connection end, a rotatable locking collar at least partially disposed within the gooseneck receiver end of the lockable gooseneck receiver, and a plurality of vertically oriented alignment pins; and a hands-free gooseneck comprising:

a substantially U-shaped gooseneck pipe member comprising an upper gooseneck connection end that is fluidly connected to a receiver connection end, wherein the receiver connection end comprises a fixed locking collar, a hands-free connection system comprising a pad-eye track disposed on the U-shaped gooseneck pipe member and a pad-eye shackle movably attached to the pad-eye track, and a plurality of vertically oriented alignment pin receivers disposed near the lower gooseneck connection end, wherein the hands-free gooseneck is lowered such that the receiver connection end is inserted into the lockable gooseneck receiver and while the hands-free gooseneck is being lowered, the plurality of alignment pins are inserted into the plurality of alignment pin receivers to ensure proper alignment, and the rotatable locking collar locks the hands-free gooseneck to the hands-free gooseneck receiver in a locked position.

2. The hands-free gooseneck flow spool of claim 1, wherein the hose connection end comprises a connector for fluidly connecting a flexible hose.

3. The hands-free gooseneck flow spool of claim 1, wherein the receiver connection end comprises a plurality of alignment protrusions for aligning the hands-free gooseneck while inserting the hands-free gooseneck into a hands-free gooseneck receiver.

4. The hands-free gooseneck flow spool of claim 1, wherein the pad-eye track comprises a threaded axial rail and the pad-eye shackle is movably attached to the threaded axial rail.

5. The hands-free gooseneck flow spool of claim 1, wherein each alignment pin receiver comprises a sheath for receiving an alignment pin disposed on a hands-free gooseneck receiver.

6. The hands-free gooseneck flow spool of claim 1, wherein the pad eye connector is connected a winch on a drilling rig that allows the hands-free gooseneck flow spool to be lowered onto a marine riser in a hands-free manner.

* * * * *